US006488783B1

(12) United States Patent
King et al.

(10) Patent No.: US 6,488,783 B1
(45) Date of Patent: Dec. 3, 2002

(54) HIGH TEMPERATURE GASEOUS OXIDATION FOR PASSIVATION OF AUSTENITIC ALLOYS

(75) Inventors: Peter J. King, Cambridge (CA); David M. Doyle, Cambridge (CA)

(73) Assignee: Babcock & Wilcox Canada, Ltd., Cambridge (CA)

( * ) Notice: Subject to any disclaimer, the term of this patent is extended or adjusted under 35 U.S.C. 154(b) by 0 days.

(21) Appl. No.: 09/821,873

(22) Filed: Mar. 30, 2001

(51) Int. Cl.[7] ..... C23C 8/04
(52) U.S. Cl. ..... 148/280; 148/286; 427/255.26
(58) Field of Search ..... 148/280, 286; 427/255.26

(56) References Cited

U.S. PATENT DOCUMENTS

| | | | | |
|---|---|---|---|---|
| 4,119,761 A | * | 10/1978 | Kuze et al. | 148/277 |
| 4,141,759 A | | 2/1979 | Pfistermeister et al. | |
| 4,153,480 A | | 5/1979 | Coester et al. | |
| 4,297,150 A | | 10/1981 | Foster et al. | |
| 4,589,929 A | | 5/1986 | Steinberg | |
| 4,636,266 A | | 1/1987 | Asay | |
| 4,799,970 A | | 1/1989 | Koiso et al. | |
| 4,820,473 A | | 4/1989 | Ohashi et al. | |
| 4,981,641 A | | 1/1991 | Campion | |
| 5,011,529 A | | 4/1991 | Hogue et al. | |
| 5,139,623 A | | 8/1992 | Ohmi et al. | |
| 5,147,597 A | | 9/1992 | Roofthooft et al. | |
| 5,188,714 A | | 2/1993 | Davidson et al. | |
| 5,199,998 A | | 4/1993 | Klingelhoefer | |
| 5,226,968 A | | 7/1993 | Ohmi et al. | |
| 5,288,345 A | | 2/1994 | Ohhashi et al. | |
| 5,413,642 A | | 5/1995 | Alger | |
| 5,741,372 A | | 4/1998 | Gugel | |
| 5,985,048 A | | 11/1999 | Wahlert et al. | |
| 6,033,493 A | | 3/2000 | Hertz et al. | |

OTHER PUBLICATIONS

Huntington Alloys Pamphlet, "INCONEL alloy 600", Internation Nickel Company, 4th Edition, 1973.*
Huntington Alloys Pamphlets, "INCONEL alloy 690", Huntington Alloys, Inc., 1980.*
Rives et al., "Surface Passivation of Inconel 690 in Flowing Ar–$O_2$–$H_2$ Microwave Post–Discharges," Vide: Science, Technique et Applications, vol. 54, No. 291, Mar. 1999, suppl. pp 333–335.
Bobin–Vastra et al., "Preoxidation of SG Alloy 690 Tubes to Decrease Metal Release in the Primary Circuit: a Laboratory Study," Proc. Eighth Int'l. Symposium on Environmental Degradation of Materials in Nuclear Power Systems—Water Reactors, vol. 1, Aug. 10–14, 1997, American Nuclear Society, pp 507–513.

* cited by examiner

*Primary Examiner*—John Sheehan
*Assistant Examiner*—Andrew L. Oltmans
(74) *Attorney, Agent, or Firm*—Kathryn W. Grant; Eric Marich

(57) ABSTRACT

A method for forming a chromium-rich layer on the surface of a nickel alloy workpiece containing chromium includes heating the workpiece to a stable temperature of about 1100° C., and then exposing the workpiece to a gaseous mixture containing water vapor and one or more non-oxidizing gases for a short period of time. The process conditions are compatible with high temperature annealing and can be performed simultaneously with, or in conjunction with, high temperature annealing.

19 Claims, 4 Drawing Sheets

HIGH TEMPERATURE GASEOUS OXIDATION FOR PASSIVATION OF AUSTENITIC ALLOYS

FIELD AND BACKGROUND OF THE INVENTION

1. Field of the Invention

The present invention is generally related to increasing the corrosion resistance of austenitic alloys such as nickel-based alloy materials, and more particularly to the formation of a chromium-rich, protective oxide layer on the surface of nickel-based alloy tubing.

2. Description of the Related Art

Nickel-based alloys containing chromium, such as Alloy 600 (UNS designation N06600) and Alloy 690 (UNS designation N06690), are commonly used in nuclear reactor systems, for example as tubing in nuclear steam generators. Release of nickel from the tubing during operation contributes to radiation fields in the primary circuits of water-cooled nuclear reactors. This is undesirable, since it increases the exposure of service personnel to radiation during maintenance.

The formation of an oxide layer on materials used in a nuclear reactor environment is known to inhibit corrosion during operation, thereby reducing radiation levels. Chromium-rich oxide surface layers are especially desirable, since they form self-healing, protective surface layers on nickel-based alloys. Iron oxide and nickel oxide layers on nickel-based alloys are not self-healing, and are therefore less desirable than chromium oxide layers. In addition, a chromium-rich oxide is a more effective barrier to the transport of nickel from the base metal. Thus the reduction of nickel release through controlled oxidation, or passivation, to produce a chromium-rich surface is a desirable goal.

Oxide layers can be formed on metal surfaces by exposure to aqueous environments at low to moderate temperatures, or by exposure to gaseous environments at moderate to high temperatures. Because of a focus on the treatment of tubing in completed and installed steam generators, efforts within the industry have been directed primarily toward aqueous oxidation processes or moderate temperature steam oxidation. Processes are known to build up a protective oxide layer on an Alloy 690 tube surface by exposing the surface to an aqueous solution containing lithium and hydrogen at 300° C. for 150 to 300 hours, or by exposure to wet air at 300° C. for 150 to 300 hours. In another known process, Alloy 690 surfaces are exposed to a gaseous Ar—$O_2$—$H_2$ mixture at intermediate temperatures of 573 to 873° K. (300–600° C.) for times between 15 and 480 minutes in a microwave post-discharge to produce a chromium-rich, protective oxide layer.

The above approaches suffer from long processing times and may impose risks to completed vessels during processing. A further problem is the relatively thin oxide layer [typically 10–50 nm and usually <100 nm] that is formed.

Austenitic alloys containing appreciable amounts of chromium are often annealed under conditions specifically selected to retain a bright surface condition, with little or no oxidation or discoloration. The annealing process conditions are normally chosen to minimize oxide formation, rather than to deliberately produce an oxide of controlled thickness. A common way of achieving this is to use hydrogen gas with a very low moisture content, as measured by a low dew point of −40° C. or lower, during the annealing process.

From the preceding discussion it is apparent, that a rapid method for producing a protective layer on nickel-based alloys would be welcomed by industry.

SUMMARY OF THE INVENTION

The present invention employs a controlled mixture of water in otherwise pure non-oxidizing gas to produce a protective, chromium-rich layer on a nickel-based alloy workpiece containing chromium, such as Alloy 600 and Alloy 690 nuclear steam generator tubing. The chromium-rich layer is produced from chromium already present in the workpiece. No external sources of chromium are required eliminating the need to buy, handle and dispose of unused amounts of this potentially hazardous material. The relatively thick chromium oxide layer provides a long term barrier to the release of nickel. The process conditions of the invention are compatible with high temperature annealing manufacturing steps. The invention can therefore be practiced simultaneously or in conjunction with high temperature annealing operations, for example during the manufacture of nuclear steam generator tubing. The invention thus provides a rapid and low cost method of passivating a nickel-based alloy workpiece containing chromium and preventing release of nickel into nuclear reactor primary coolant, while maintaining short construction schedules. Performing the passivation during tube manufacture also avoids the risks and penalties of passivating tubing in the finished vessel.

Accordingly one aspect of the present invention is drawn to a method of forming a chromium-rich layer on a surface of a nickel-based alloy workpiece that contains chromium. The chromium contained in the workpiece is oxidized by heating the workpiece to a temperature sufficient to oxidize the chromium, and exposing the workpiece to a gaseous mixture of water vapor and one or more non-oxidizing gases.

Another aspect of the invention is drawn to a method of forming a chromium-rich layer, including chromium oxide, on a surface of a nickel-based alloy workpiece that contains chromium, by heating the workpiece to a temperature of about 1100° C., and exposing the surface of the workpiece to a flowing gaseous mixture of hydrogen and water having a water content in the range of about 0.5% to 10% for at least about 3 to 5 minutes.

Yet another aspect of the invention is drawn to a method of forming a chromium-rich layer consisting essentially of chromium oxide, on a surface of a nickel-based alloy workpiece that contains chromium, by heating the workpiece to a temperature of about 1100° C., and exposing the surface of the workpiece to a flowing gaseous mixture of hydrogen and water having a water content in the range of about 0.5% to 10% for at least about 3 to 5 minutes.

The various features of novelty which characterize the invention are pointed out with particularity in the claims annexed to and forming a part of this disclosure. For a better understanding of the invention, its operating advantages and specific objects attained by it use, reference is made to the accompanying drawings and descriptive matter in which a preferred embodiment of the invention is illustrated.

BRIEF DESCRIPTION OF THE DRAWINGS In the drawings.

DESCRIPTION OF THE PREFERRED EMBODIMENTS

Figure 1A:
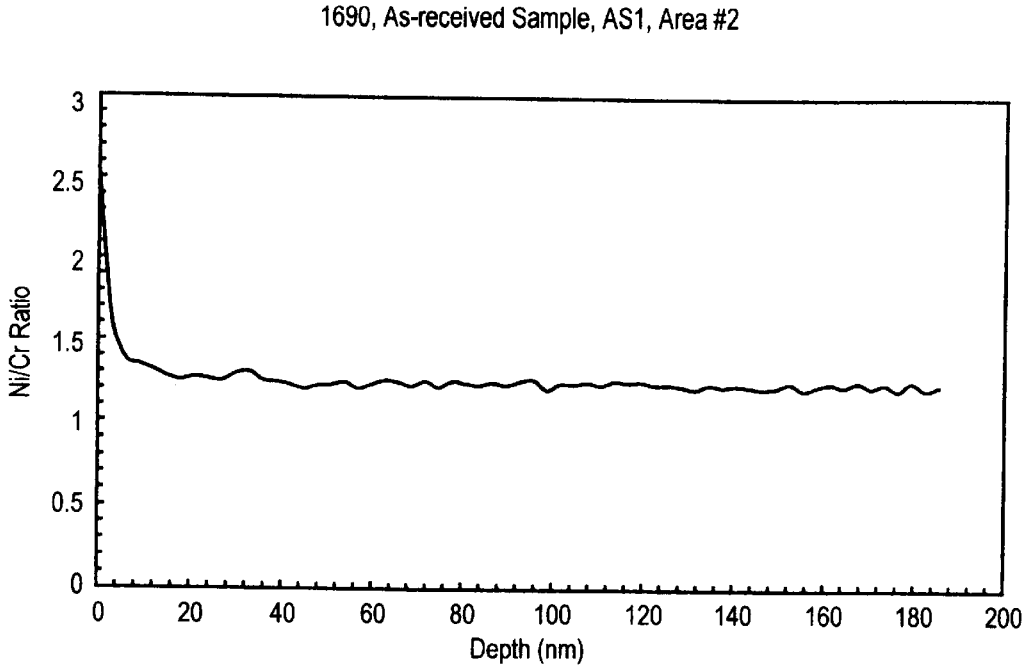
FIG. 1 illustrates Ni/Cr and O/Cr ratios as a function of depth for an Alloy 690 sample prior to treatment in accordance with the present invention.

The present invention is a method for forming a chromium-rich layer on the surface of a nickel-based alloy workpiece such as Alloy 690 nuclear steam generator tubing. The process includes heating the workpiece to a temperature of about 1100° C., and exposing the workpiece to a gaseous mixture containing water vapor for a short period of time. The gaseous mixture comprises water vapor and one or more non-oxidizing gases, preferably hydrogen, but argon or helium are also satisfactory. The process conditions are compatible with high temperature annealing and can be performed simultaneously with, or in conjunction with, e.g. shortly before or after, a high temperature annealing step.

In a preferred embodiment, a nickel-based alloy workpiece is exposed to a flowing gaseous mixture of water in otherwise pure hydrogen, having a water content in the range of 0.5% to 10% (molecular concentration), corresponding to a dew point of about 7° C. to 46° C., for 3 to 5 minutes at 1100° C. to form a chromium-rich oxide layer of 250 nanometers (nm) to 400 nanometers (nm) thickness, and containing less than 1% by weight of nickel, on the surface of the workpiece.

The moisture content range is preferably selected to be well above the minimum that would oxidize chromium (a molecular concentration of about 0.08% moisture, corresponding to a dew point of about −25° C.), and yet well below the minimum moisture content that would oxidize either iron or nickel (about 40% moisture, corresponding to a dew point of about 76° C., would be required for iron, and an even higher moisture content for nickel).

Tests were conducted on 1 centimeter long pieces of Alloy 690 tubing having an outside diameter (OD) of 0.625" and a nominal wall thickness (WT) of 0.040". The objective of these tests was to characterize the oxide layers formed on an inside diameter (ID) surface of the Alloy 690 tubing as a result of treatment at 1100° C. under three different processing conditions, and to compare them to untreated tubing. The following samples were tested:

TABLE 1

| Test Sample Description | |
|---|---|
| Sample | Treatment |
| AS1 | As-received sample, Area #1 |
| AS1 | As-received sample, Area #2 |
| AS2 | As-received sample |
| AS3 | As-received sample |
| H5 | $H_2$ treatment |
| H6 | $H_2$ treatment |
| H7 | $H_2$ treatment |
| H8 | $H_2$ treatment |
| HLW1 | $H_2 + H_2O$ (1.5° C.) |
| HLW2 | $H_2 + H_2O$ (1.5° C.) |
| HLW3 | $H_2 + H_2O$ (1.5° C.) |
| HLW4 | $H_2 + H_2O$ (1.5° C.) |
| HW1 | $H_2 + H_2O$ (28° C.) |

TABLE 1-continued

| Test Sample Description | |
|---|---|
| Sample | Treatment |
| HW2 | $H_2 + H_2O$ (28° C.) |
| HW3 | $H_2 + H_2O$ (28° C.) |
| HW4 | $H_2 + H_2O$ (28° C.) |

EXAMPLE 1

No Treatment

Three untreated [as-received] samples of Alloy 690 tubing were examined by X-ray Photoelectron Spectroscopy (XPS) survey scan to determine the outer surface composition, and by Auger analysis to determine the outer surface composition, oxide thickness and Ni/Cr and O/Cr ratios. As shown in Table 2, the as-received Alloy 690 samples (AS1, AS2 and AS3) had only small amounts of chromium at their surfaces, and had almost as much nickel as chromium.

EXAMPLE 2

Treatment with Dry $H_2$

The inner diameter (ID) surfaces of four samples of Alloy 690 tubing were cleaned by blowing them with dry air. No solvents were used to clean the samples.

A treatment was performed in a tube furnace through which passed a quartz tube of sufficient length to provide an ambient temperature region antechamber. Four samples of Alloy 690 tubing were placed in the antechamber and a purging gas flow of dry argon gas was established. Purging with dry argon gas continued while the furnace was heated up. The samples remained in the antechamber during heating. Once the temperature reached 1100° C. (about 90 minutes after heating started), the dry argon gas was replaced with dry hydrogen gas (<1 ppm impurities) at a flow rate of about 140 mL/min and the temperature was stabilized at 1100° C., after which the samples were introduced into the furnace.

After the temperature re-stabilized at 1100° C., the samples were treated for 3 minutes at 1100° C. The samples were removed from the furnace to the antechamber, and cooled in dry argon gas flowing at a rate much greater than 140 mL/min.

EXAMPLE 3

Treatment with $H_2$ and a Low Level of Water Vapor (Humidified by Water at 1.5° C.)

The experiment of Example 2 was repeated with four samples, but with the following modification. Once the samples were introduced into the furnace and the temperature had re-stabilized at 1100° C., the flow of dry hydrogen gas was replaced with a gaseous mixture of hydrogen and water vapor at a flow rate of about 140 mL/min. The water vapor was introduced by humidifying the hydrogen in a water bath maintained at about 1.5° C. (packed with ice) to produce an estimated absolute moisture content of about 0.7%.

EXAMPLE 4

Treatment with $H_2$ and a Higher Level of Water Vapor (Humidified by Water at 28° C.)

The experiment of Example 3 was repeated with four samples, but with the following modification. The water vapor was introduced by humidifying the hydrogen in a water bath maintained at about 28° C. to produce an estimated moisture content of about 3.7%.

Results of Field Emission SEM Examination

To directly determine the thickness of the oxide produced, the samples were bent vigorously thus cracking some of the oxide layer at the ID surface. SEM micrograph images taken after fracture indicate that the thickness of the oxide layer was similar for the oxides grown via either treatment with water vapor. SEM examination of the samples also revealed that heat treating under water vapor appeared to produce an oxide layer that contained some porosity.

Results of XPS and Auger Analysis

Compositional data obtained from XPS survey scan spectra are summarized in Table 2. In this presentation, carbon has been omitted and the remaining elements normalized to 100% so that trends in composition can be clearly observed.

TABLE 2

XPS Surface Composition (atomic %) of Alloy 690 Tube Samples
Elements Detected (other than Carbon) normalized to 100%

| Sample | O | Ni | Cr | Fe | Mn | Ti | Si | S | P | Ca | Cl | N | Al |
|---|---|---|---|---|---|---|---|---|---|---|---|---|---|
| AS1 | 58. | 5.8 | 6.2 | 1.2 | — | — | — | 14. | — | 1.7 | 3.2 | 7.2 | 2.4 |
| AS2 | 56. | 5.4 | 9.0 | 0.9 | — | — | — | 11. | — | 2.1 | 5.5 | 3.9 | 1.8 |
| AS3 | 63. | 6.8 | 7.0 | 1.2 | — | — | — | 8.3 | — | 1.4 | 3.2 | 5.3 | 2.6 |
| H5 | 59. | 13. | 7.4 | 1.7 | — | 5.4 | — | 1.5 | — | 1.6 | — | — | 9.1 |
| H6 | 58. | 14. | 9.1 | 0.9 | — | 4.9 | — | 1.7 | — | 2.4 | — | — | 8.4 |
| H7 | 55. | 9.7 | 6.4 | 0.9 | — | 6.1 | — | 2.1 | — | 1.5 | — | 1.1 | 18. |
| H8 | 56. | 12. | 8.4 | 1.2 | — | 5.4 | — | 1.2 | — | 1.6 | — | 1.4 | 13. |
| HLW1 | 58. | — | 34. | — | 2.9 | 3.6 | — | — | — | 1.4 | — | 0.3 | — |
| HLW2 | 61. | — | 32. | — | 2.6 | 3.3 | — | — | — | 0.8 | — | 0.2 | — |
| HLW3 | 58. | — | 33. | — | 1.6 | 2.9 | 1.0 | — | 1.7 | 1.0 | — | 0.6 | — |
| HLW4 | 58. | — | 34. | — | 1.7 | 1.7 | 1.4 | — | — | 1.7 | — | 1.0 | — |
| HW1 | 58. | — | 33. | — | 2.9 | 3.5 | — | — | — | 1.8 | — | 0.7 | — |
| HW2 | 57. | — | 34. | — | 2.4 | 3.5 | — | — | — | 2.4 | — | — | — |
| HW3 | 60. | — | 32. | — | 2.7 | 3.1 | — | — | — | 1.7 | — | 0.6 | — |
| HW4 | 56. | — | 35. | — | 2.9 | 3.3 | — | — | — | 1.5 | — | 0.9 | — |

The trends observed in Auger survey scan spectra are similar to those observed in the XPS analysis. Representative depth profiles collected from the samples of interest via Auger analysis show a reasonably thick, chromium-enriched oxide layer after the heat treatments of Examples 3 and 4.

Figure 1B:
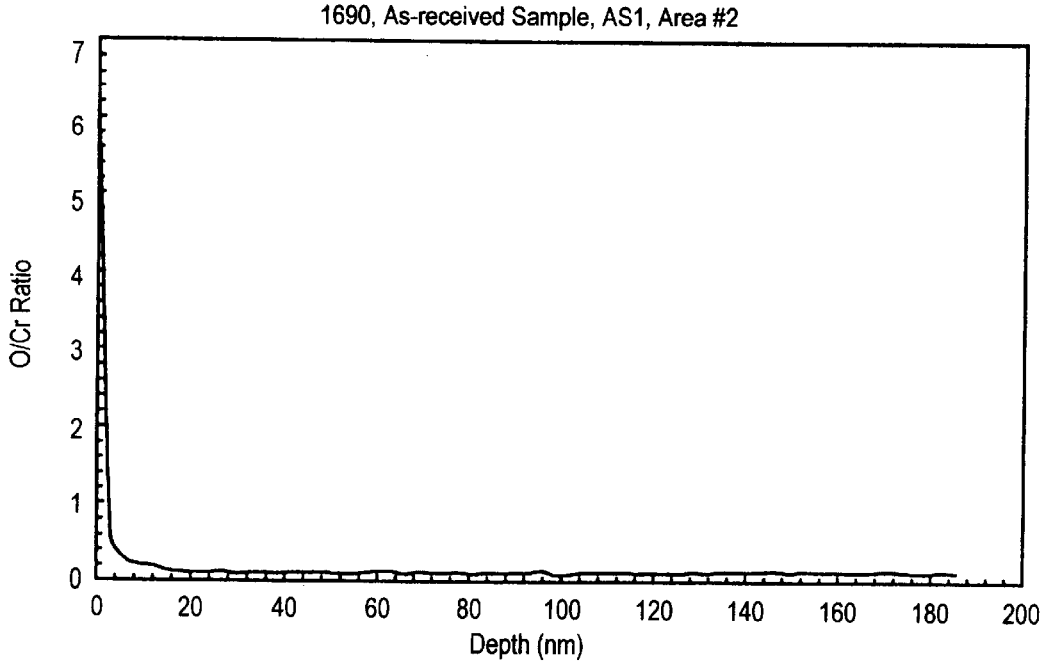

FIG. 1 illustrates a typical composition profile at the surface of clean Alloy 690 prior to treatment according to the present invention. It is seen in the upper part of this figure that the surface in this condition is enriched in the amount of nickel relative to chromium when compared to the composition beneath the surface. The lower part of this figure shows that the surface contains oxygen, but only to a very shallow depth of <10 nm.

Figure 2A:
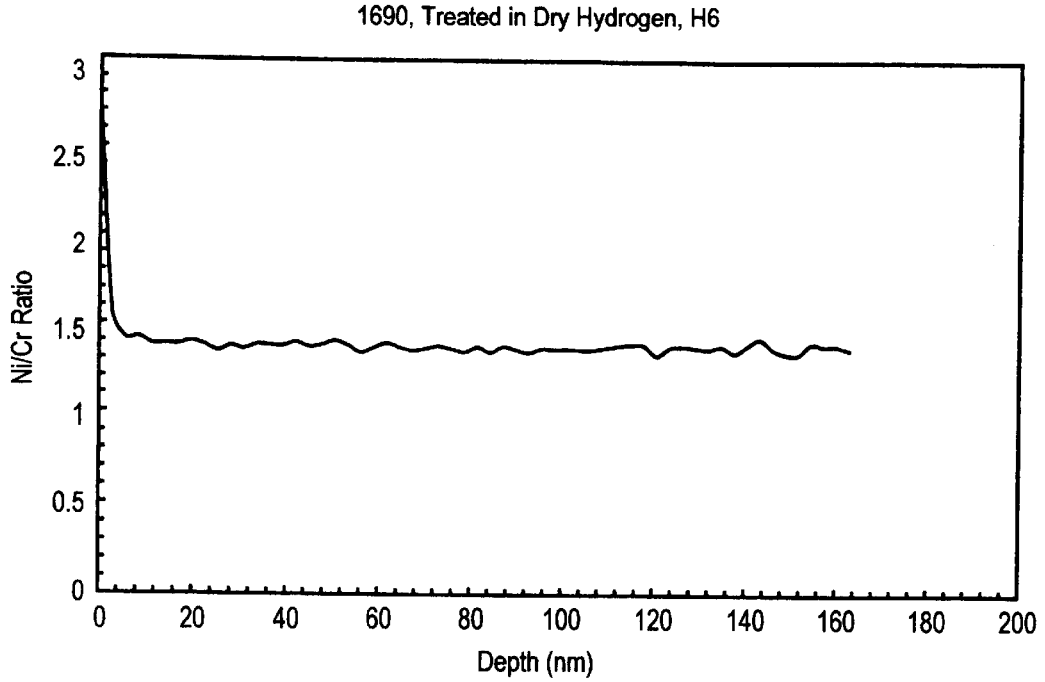
FIG. 2 illustrates Ni/Cr and O/Cr ratios as a function of depth for an Alloy 690 sample after treatment with dry hydrogen.
Figure 2B:
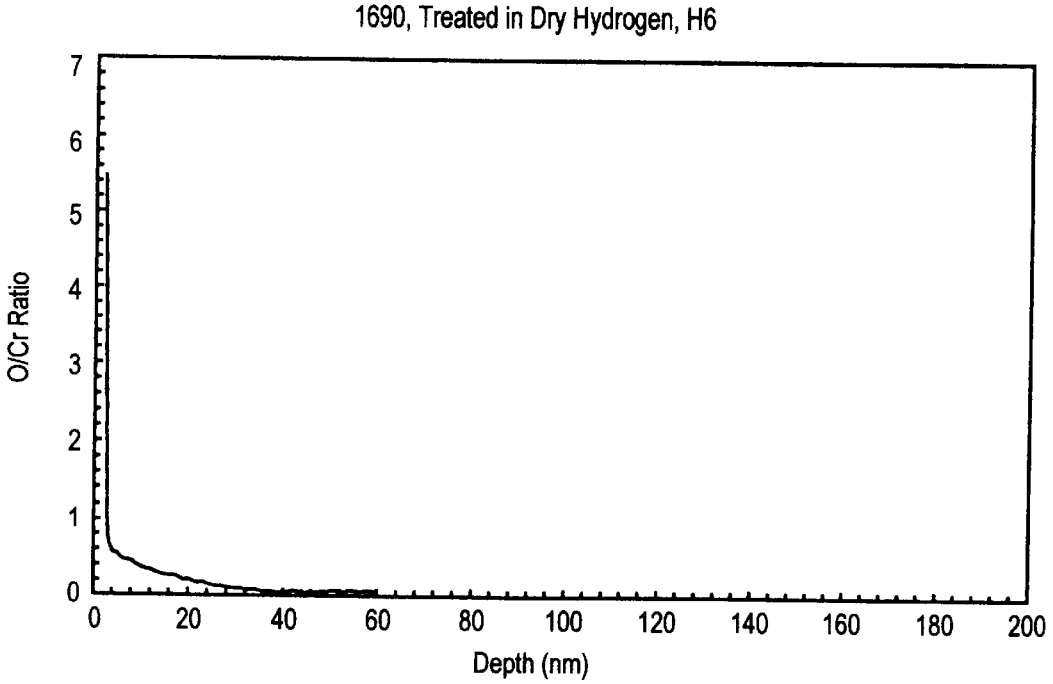

FIG. 2 illustrates a typical condition at the surface of Alloy 690 after treatment in dry hydrogen. The surface is little changed in relative composition from that shown in FIG. 1.

Figure 3A:
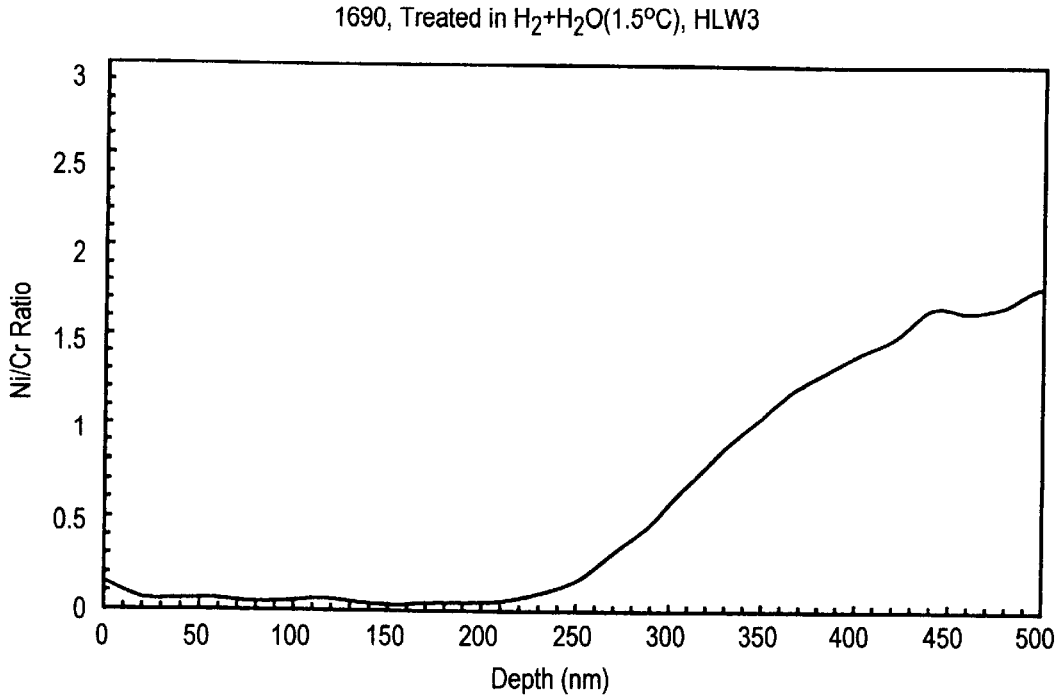
FIG. 3 illustrates Ni/Cr and O/Cr ratios as a function of depth for an Alloy 690 sample after treatment in accordance with the present invention with a gaseous mixture containing relatively low amounts of water vapor.
Figure 3B:
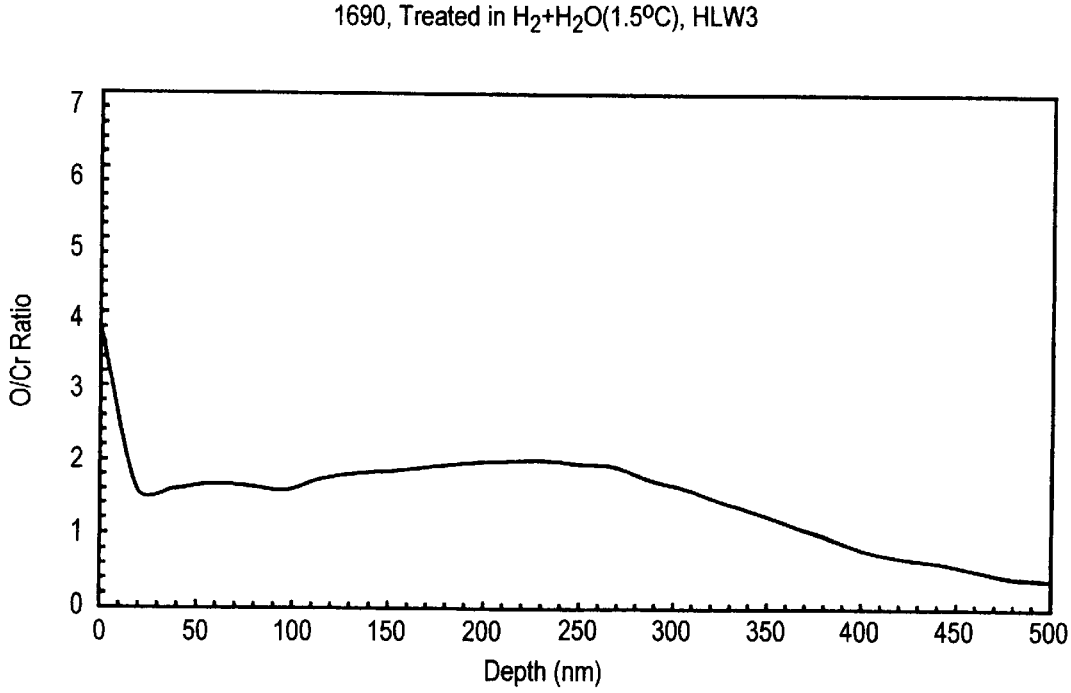

FIG. 3 illustrates a typical condition at the surface of Alloy 690 produced by exposure to a hydrogen-water vapor mixture in the low end of the specified moisture content range. The surface condition is considerably changed from those in FIGS. 1 and 2. The upper curve illustrates that the surface contains only a very small amount of nickel compared to chromium for a significant depth of >200 nm. The lower curve shows that the outer layer of the surface contains a substantial amount of oxygen, equivalent to the relative amount of oxygen present in chromium oxides, for a depth of >200 nm.

Figure 4A:
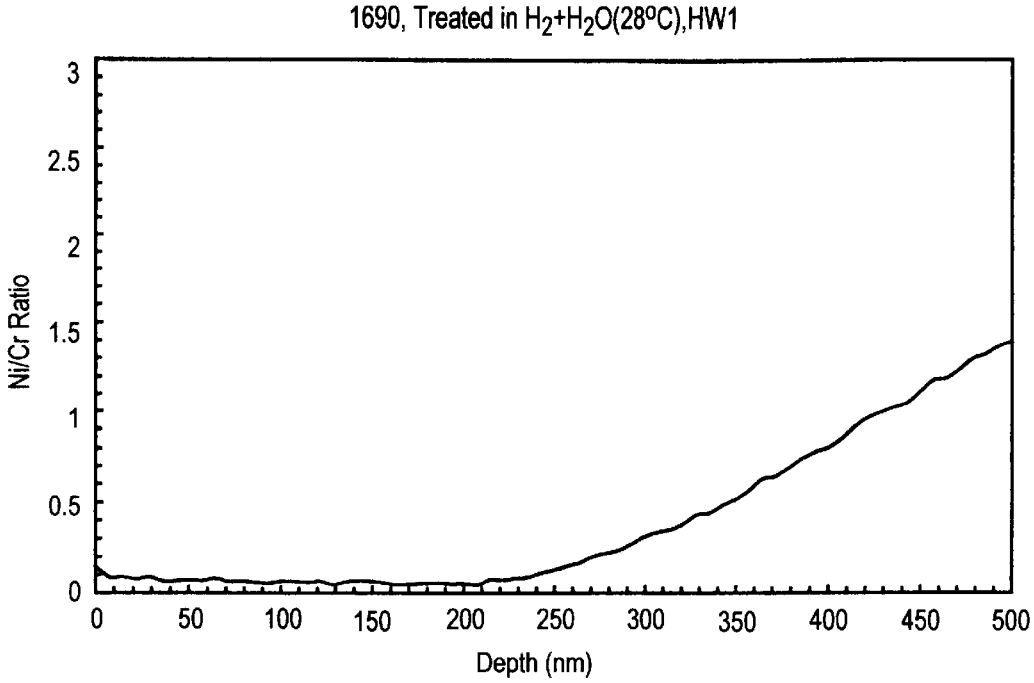
FIG. 4 illustrates Ni/Cr and O/Cr ratios as a function of depth for an Alloy 690 sample after treatment in accordance with the present invention with a gaseous mixture containing relatively high amounts of water vapor.
Figure 4B:
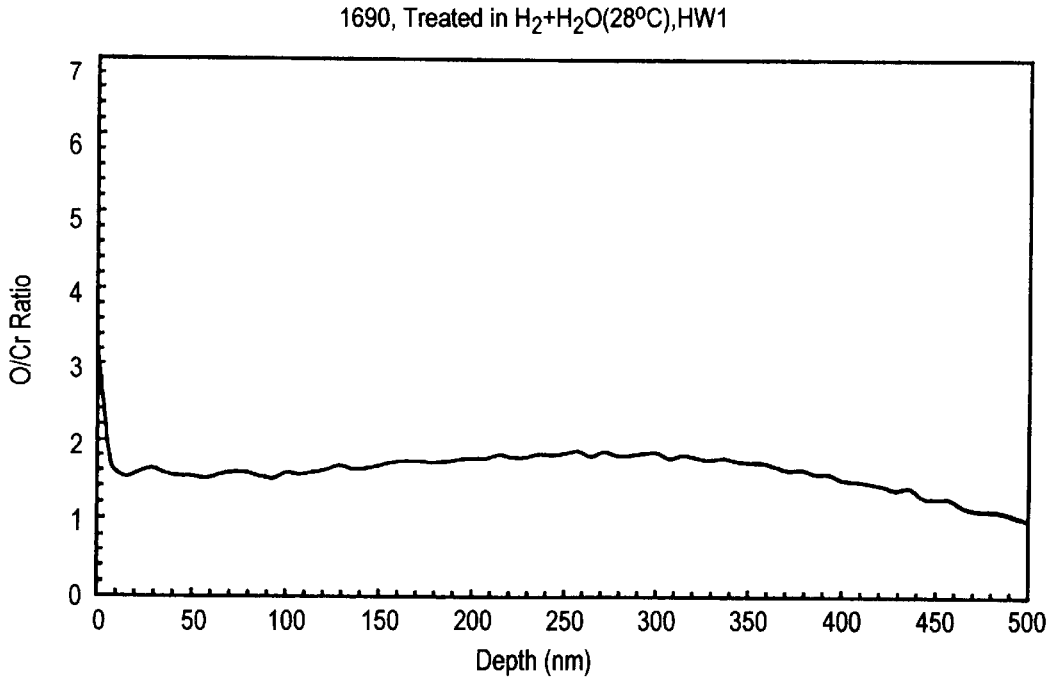

FIG. 4 further illustrates the relative composition of the surface after treatment in a hydrogen-water vapor mixture at the higher end of the specified moisture content range. The characteristics are substantially similar to those in FIG. 3.

Treatment in the presence of water vapor (both low and high levels) appears to produce an outer oxide layer consisting entirely of chromium oxide ($Cr_2O_3$). It is apparent that the outer oxide is essentially devoid of nickel.

Oxide thickness values, estimated from the Auger depth profiles and presented in Table 3, indicate that the heat treatments of Examples 3 and 4, under two different water vapor levels, produced oxide of similar thickness.

TABLE 3

Results from Oxide Layer Thickness Measurements

| Sample | Treatment | Estimated Oxide Layer Thickness (nm) | Width of Chromium Diffusion Region (nm) |
|---|---|---|---|
| AS1 | As-received sample, Area #1 | 11 | — |
| AS1 | As-received sample, Area #2 | 2 | — |
| AS2 | As-received sample | 1 | — |
| AS3 | As-received sample | 1 | — |
| AR1 | Argon | 5 | — |
| AR2 | Argon | 5 | — |
| H5 | $H_2$ | 12 | — |
| H6 | $H_2$ | 4 | — |
| H7 | $H_2$ | 8 | — |
| H8 | $H_2$ | 13 | — |
| HLW1 | $H_2 + H_2O$ (1.5° C.) | 417 | 1265 |
| HLW2 | $H_2 + H_2O$ (1.5° C.) | 521 | 1879 |
| HLW3 | $H_2 + H_2O$ (1.5° C.) | 348 | 1202 |
| HLW4 | $H_2 + H_2O$ (1.5° C.) | 300 | 1054 |
| HW1 | $H_2 + H_2O$ (28° C.) | 462 | 1399 |
| HW2 | $H_2 + H_2O$ (28° C.) | 548 | 1824 |
| HW3 | $H_2 + H_2O$ (28° C.) | 400 | >600 |
| HW4 | $H_2 + H_2O$ (28° C.) | 314 | 1686 |

Ni/Cr and O/Cr ratios obtained from Auger depth profiles (FIGS. 3 and 4) for each of the heat treatments studied showed that the composition of the oxide layer appears to be similar for heat treatments with either level of water vapor (Examples 3 and 4.) Thus, the results for both oxide thickness and composition indicate that, in the selected range, the amount of water vapor is not the controlling factor for growth of a chromium-rich oxide layer on the Alloy 690 ID surface. This large process tolerance thus allows for simple control and high quality assurance.

Because many varying and differing embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense. For example, different temperature/time combinations could be employed to suit different annealing requirements, or to produce oxides of differing thickness or porosity.

We claim:

1. A method of forming a chromium-rich layer on a surface of a nickel-based alloy workpiece containing chromium, comprising:

a. heating the workpiece to a temperature sufficient to oxidize the chromium;

b. exposing at least one portion of the surface of the workpiece to a gaseous mixture of water vapor and at least one non-oxidizing gas to oxidize the chromium contained within the workpiece to form a chromium-rich layer on the at least one portion of the surface of the workpiece; and c. wherein the surface of the workpiece comprises an inside surface of a tube used in a primary circuit of a water-cooled nuclear reactor.

2. The method of claim 1, wherein the at least one non-oxidizing gas comprises hydrogen, argon, helium and mixtures thereof.

3. The method of claim 1, wherein the workpiece is heated to a temperature of about 1100° C.

4. The method of claim 1, wherein the workpiece is held at a temperature sufficient to oxidize the chromium for at least about 3 to 5 minutes.

5. The method of claim 1, wherein the gaseous mixture has a water content in the range of about 0.08% to about 40%.

6. The method of claim 1, wherein the chromium-rich layer further comprises chromium oxide.

7. A method of forming a chromium-rich layer on a surface of a nickel-based alloy workpiece containing chromium, comprising:

a. heating the workpiece to a temperature sufficient to oxidize the chromium;

b. exposing at least one portion of the surface of the workpiece to a gaseous mixture of water vapor and at least one non-oxidizing gas to oxidize the chromium contained within the workpiece to form a chromium-rich layer on the at least one portion of the surface of the workpiece; and c. wherein the workpiece is exposed to a substantially dry, non-oxidizing gas while heating the workpiece to a temperature sufficient to oxidize the chromium.

8. The method of claim 7, wherein the workpiece is exposed to substantially dry hydrogen gas while heating the workpiece to a temperature sufficient to oxidize the chromium.

9. The method of claim 1, wherein the gaseous mixture has a water content in the range of 0.5% to 10%.

10. The method of claim 1, wherein the nickel-based alloy comprises one of Alloy 690 and Alloy 600.

11. A method of forming a chromium-rich layer on a surface of a nickel-based alloy workpiece containing chromium, comprising:

a. heating the workpiece to a temperature sufficient to oxidize the chromium;

b. exposing at least one portion of the surface of the workpiece to a gaseous mixture of water vapor and at least one non-oxidizing gas to oxidize the chromium contained within the workpiece to form a chromium-rich layer on the at least one portion of the surface of the workpiece;

c. wherein the at least one non-oxidizing gas comprises hydrogen, argon, helium and mixtures thereof;

d. wherein the gaseous mixture has a water content in the range of 0.5% to 10%;

e. wherein the workpiece is held at a temperature of about 1100° C. for about 3 to 5 minutes;

f. wherein the nickel-based alloy comprises one of Alloy 690 and Alloy 600, and g. wherein the workpiece is exposed to substantially dry hydrogen gas while heating the workpiece to a temperature sufficient to oxidize the chromium.

12. A method of forming a chromium-rich layer on a surface of a nickel-based alloy workpiece containing chromium, comprising:

a. heating the workpiece to a temperature sufficient to oxidize the chromium;

b. exposing at least one portion of the surface of the workpiece to a gaseous mixture of water vapor and at least one non-oxidizing gas to oxidize the chromium contained within the workpiece to form a chromium-rich layer on the at least one portion of the surface of the workpiece; and c. wherein the workpiece comprises a nuclear steam generator tube.

13. The method of claim 12, wherein the at least one non-oxidizing gas comprises hydrogen, argon, helium and mixtures thereof.

14. The method of claim 12, wherein the workpiece is heated to a temperature of about 1100° C.

15. The method of claim 12, wherein the workpiece is held at a temperature sufficient to oxidize the chromium for at least about 3 to 5 minutes.

16. The method of claim 12, wherein the gaseous mixture has a water content in the range of about 0.08% to about 40%.

17. The method of claim 12, wherein the gaseous mixture has a water content in the range of 0.5% to 10%.

18. The method of claim 12, wherein the chromium-rich layer further comprises chromium oxide.

19. The method of claim 12, wherein the nickel-based alloy comprises one of Alloy 690 and Alloy 600.

* * * * *